US009195213B2

(12) United States Patent
Hara et al.

(10) Patent No.: US 9,195,213 B2
(45) Date of Patent: Nov. 24, 2015

(54) IMAGE FORMING APPARATUS INCLUDING FAN TO GENERATE AIR FLOW IN CONVEYANCE PATH IN SHEET CONVEYANCE DIRECTION

(71) Applicant: KONICA MINOLTA, INC., Chiyoda-ku, Tokyo (JP)

(72) Inventors: Kazuyoshi Hara, Itami (JP); Hidetoshi Noguchi, Tahara (JP); Satoru Shibuya, Chiryu (JP); Takahiro Kuroda, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/309,734

(22) Filed: Jun. 19, 2014

(65) Prior Publication Data

US 2014/0376950 A1 Dec. 25, 2014

(30) Foreign Application Priority Data

Jun. 20, 2013 (JP) ..... 2013-129628

(51) Int. Cl.
*G03G 15/00* (2006.01)
*G03G 21/20* (2006.01)

(52) U.S. Cl.
CPC ..... *G03G 21/206* (2013.01); *G03G 15/6573* (2013.01); *G03G 2215/00679* (2013.01)

(58) Field of Classification Search
CPC ..... G03G 21/206; G03G 15/6573; G03G 2215/00679
See application file for complete search history.

(56) References Cited

U.S. PATENT DOCUMENTS 4,013,354 A * 3/1977 Komori et al. ..... 399/99
4,169,673 A * 10/1979 Sato et al. ..... 399/317
4,319,828 A * 3/1982 Komori et al. ..... 399/92
4,693,588 A * 9/1987 Yarbrough et al. ..... 399/93
5,155,531 A * 10/1992 Kurotori et al. ..... 399/93

(Continued)

FOREIGN PATENT DOCUMENTS

JP 61080277 A 4/1986
JP 07134532 A 5/1995

(Continued)

OTHER PUBLICATIONS

Japanese Office Action (and English translation thereof) dated Jul. 1, 2015, issued in counterpart Japanese Application No. 2013-129628.

*Primary Examiner* — David Bolduc
(74) *Attorney, Agent, or Firm* — Holtz Holtz, Goodman & Chick PC

(57) ABSTRACT

An image forming apparatus includes an image carrier configured to carry a toner image. A transfer unit is configured to transfer the toner image on the image carrier onto a recording sheet. A fixing unit is configured to fix the toner image transferred at the transfer unit onto the recording sheet. Through a conveyance path, the recording sheet is conveyed from the transfer unit to the fixing unit. A conveyance guide member is disposed in the conveyance path on an image formation surface side of the recording sheet. A fan is configured to send air from the transfer unit to the conveyance path toward a gap defined between the conveyance guide member and the transfer unit so as to form a flow of air in the conveyance path from an upstream side to a downstream side in a conveyance direction of the recording sheet.

11 Claims, 7 Drawing Sheets

(56) References Cited

U.S. PATENT DOCUMENTS

| | | | | |
|---|---|---|---|---|
| 5,309,209 | A * | 5/1994 | Huh | 399/69 |
| 6,058,287 | A * | 5/2000 | Haneda et al. | 399/397 |
| 6,801,742 | B1 * | 10/2004 | Mochimaru et al. | 399/309 |
| 7,194,222 | B2 * | 3/2007 | Murooka | 399/92 |
| 7,469,112 | B2 * | 12/2008 | Yuasa | 399/92 |
| 7,953,343 | B2 * | 5/2011 | Kawamata | 399/92 |
| 8,380,114 | B2 * | 2/2013 | Watanabe | 399/341 |
| 2005/0078976 | A1 * | 4/2005 | Deguchi et al. | 399/92 |
| 2005/0238379 | A1 * | 10/2005 | Ogane et al. | 399/92 |
| 2006/0051124 | A1 * | 3/2006 | Oka | 399/94 |
| 2006/0284960 | A1 * | 12/2006 | Kishi | 347/140 |
| 2007/0059022 | A1 * | 3/2007 | Yamaoka et al. | 399/92 |
| 2007/0212104 | A1 * | 9/2007 | Miyamoto et al. | 399/92 |
| 2008/0031669 | A1 * | 2/2008 | Takei | 399/397 |
| 2008/0050144 | A1 * | 2/2008 | Hashimoto | 399/92 |
| 2008/0232872 | A1 * | 9/2008 | Kimura | 399/331 |
| 2008/0240769 | A1 * | 10/2008 | Kawasaki et al. | 399/92 |
| 2009/0190981 | A1 * | 7/2009 | Tanaka | 399/397 |
| 2010/0189476 | A1 * | 7/2010 | Tanaka et al. | 399/313 |
| 2010/0260519 | A1 * | 10/2010 | Kamijo et al. | 399/297 |
| 2010/0260520 | A1 * | 10/2010 | Kamijo | 399/304 |
| 2010/0266317 | A1 * | 10/2010 | Kamijo et al. | 399/316 |
| 2010/0266318 | A1 * | 10/2010 | Kamijo et al. | 399/316 |
| 2010/0272480 | A1 * | 10/2010 | Kamijo et al. | 399/304 |
| 2011/0064449 | A1 * | 3/2011 | Shimizu | 399/92 |
| 2011/0142486 | A1 | 6/2011 | Komiyama et al. | |
| 2012/0002997 | A1 * | 1/2012 | Hiraoka et al. | 399/92 |
| 2012/0107009 | A1 * | 5/2012 | Yano | 399/92 |
| 2014/0161481 | A1 * | 6/2014 | Udagawa | 399/92 |
| 2014/0178091 | A1 * | 6/2014 | Sugiyama et al. | 399/92 |
| 2014/0376949 | A1 * | 12/2014 | Fujita et al. | 399/92 |

FOREIGN PATENT DOCUMENTS

| | | | |
|---|---|---|---|
| JP | 07319246 | A | 12/1995 |
| JP | 2001163499 | A | 6/2001 |
| JP | 2001272893 | A | 10/2001 |
| JP | 2009180759 | A | 8/2009 |
| JP | 2011123387 | A | 6/2011 |

* cited by examiner

IMAGE FORMING APPARATUS INCLUDING FAN TO GENERATE AIR FLOW IN CONVEYANCE PATH IN SHEET CONVEYANCE DIRECTION

CROSS-REFERENCE TO RELATED APPLICATIONS

The present application claims priority under 35 U.S.C. §119 to Japanese Patent Application No. 2013-129628, filed Jun. 20, 2013. The contents of this application are incorporated herein by reference in their entirety.

BACKGROUND OF THE INVENTION

1. Field of the Invention

The present invention relates to an image forming apparatus.

2. Description of the Background

Electrophotographic image forming apparatuses transfer a toner image formed on an image carrier onto a recording sheet at a transfer unit, and then heat and press the recording sheet at a fixing unit so as to fix the toner image on the recording sheet, thus forming an image. At the time when the recording sheet is separated from the image carrier after the toner image has been transferred onto the recording sheet from the image carrier, shearing force is generated between the toner transferred to the recording sheet side and the toner remaining on the image carrier. As a result, the toner can scatter from the shear plane. Even though some of the toner remain on the image carrier, the level of charging of the remaining toner is low, which causes the remaining toner to scatter due to the rotation force of the image carrier. Thus, the toner scatters and flows in the conveyance path, and in addition to the toner, powder dust also flows in the conveyance path. The powder dust results from recording sheet fiber and additive resulting from friction between the transfer roller and the recording sheet.

In an attempt to reduce such powder dust, Japanese Unexamined Patent Application Publication No. 2011-123387 discloses an image forming apparatus that arranges a suction port of a suction device, which sucks powder dust such as flowing toner, adjacent to a second transfer cleaning device, which removes toner remaining on a second transfer belt. The image forming apparatus recited in Japanese Unexamined Patent Application Publication No. 2011-123387 passes a recording sheet through an intermediate transfer belt and the second transfer belt so as to transfer a toner image on the intermediate transfer belt onto the recording sheet. In this configuration, the suction port of the suction device is disposed adjacent to the second transfer belt on the back surface of the recording sheet (which is the side on which no image is formed). This ensures that powder dust sucked through the suction port is collected by a filter in the suction device.

The powder dust resulting from flowing toner and recording sheet fiber flowing in the conveyance path attaches to and accumulates on a conveyance guide and other elements that constitute the conveyance path. Thus, when the recording sheet conveyed through the conveyance path comes to the conveyance guide, the recording sheet contacts the conveyance guide due to the charging state of the recording sheet or similar causes, powder dust and other substances attach on the recording sheet. This results in noise generated in the image on the recording sheet. In this respect, even though the image forming apparatus recited in Japanese Unexamined Patent Application Publication No. 2011-123387 provides a suction device, the suction device performs its suction on the opposite side of the image formation surface of the recording sheet, instead of removing powder dust on the side of the image formation surface. Thus, the image forming apparatus recited in Japanese Unexamined Patent Application Publication No. 2011-123387 can be insufficient for reducing image noise.

In the conveyance path between the transfer unit and the fixing unit, the passage of the recording sheet and the rotation of the intermediate transfer belt cause the air in the conveyance path to flow in the recording sheet movement direction and in the belt rotation direction. Additionally, closed space is defined by the recording sheet and the intermediate transfer belt, and this makes the upstream side in the recording sheet conveyance direction into negative pressure. This causes another flow of air, in addition to the above-described flow of air, in a direction opposite the recording sheet conveyance direction along the guide member on the downstream side of the intermediate transfer belt. That is, in the conveyance path, flows of air occur in the recording sheet conveyance direction and in the opposite direction. These flows of air cause a swirling current, which in turn causes the toner to be swirled up to attach to the recording sheet, resulting in occurrence of image noise.

The present invention has been made in view of the above-described circumstances, and it is an object of the present invention to provide an image forming apparatus capable of preventing flowing toner and other substances in the conveyance path for the recording sheet from attaching to the recording sheet loaded with a transferred toner image, thereby minimizing occurrence of image noise.

SUMMARY OF THE INVENTION

According to one aspect of the present invention, an image forming apparatus includes an image carrier, a transfer unit, a fixing unit, a conveyance path, a conveyance guide member, and a fan. The image carrier is configured to carry a toner image. The transfer unit is configured to transfer the toner image on the image carrier onto a recording sheet. The fixing unit is configured to fix the toner image transferred at the transfer unit onto the recording sheet. Through the conveyance path, the recording sheet is conveyed from the transfer unit to the fixing unit. The conveyance guide member is disposed in the conveyance path on an image formation surface side of the recording sheet. The fan is configured to send air from the transfer unit to the conveyance path toward a gap defined between the conveyance guide member and the transfer unit so as to form a flow of air in the conveyance path from an upstream side to a downstream side in a conveyance direction of the recording sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 2:
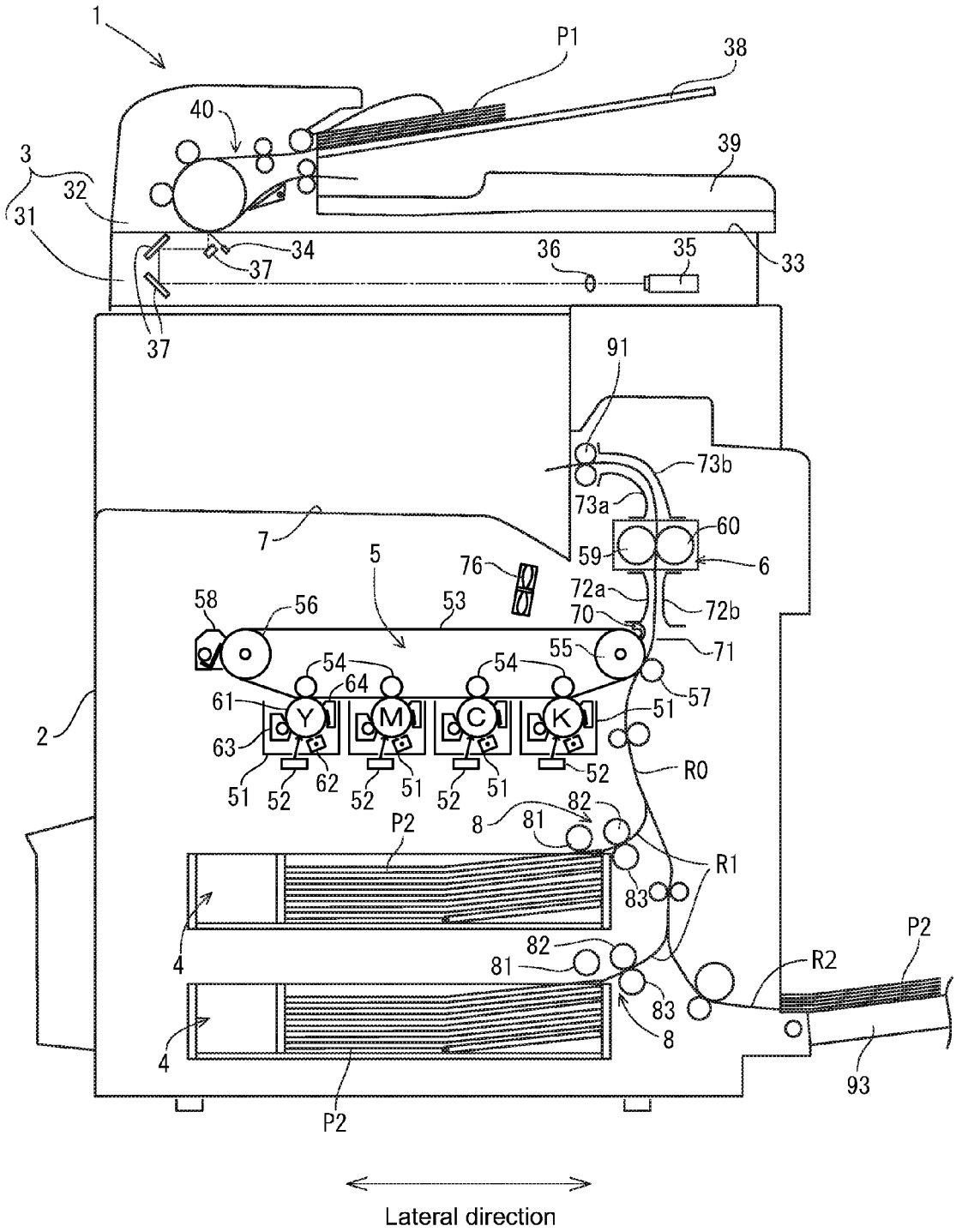
FIG. 2 is a schematic configuration diagram illustrating an inner configuration of the image forming apparatus shown in FIG. 1.

Embodiments of the present invention will now be described by referring to the accompanying drawings. In the following description, terms indicating specific directions and positions (for example, "left and right" and "upper and lower") are used where necessary. In this respect, the direction perpendicular to the paper plane of FIG. 2 is defined as front view. The terms are used for the sake of description and will not limit the technical scope of the present invention.

Overall Configuration of Image Forming Apparatus

Figure 1:
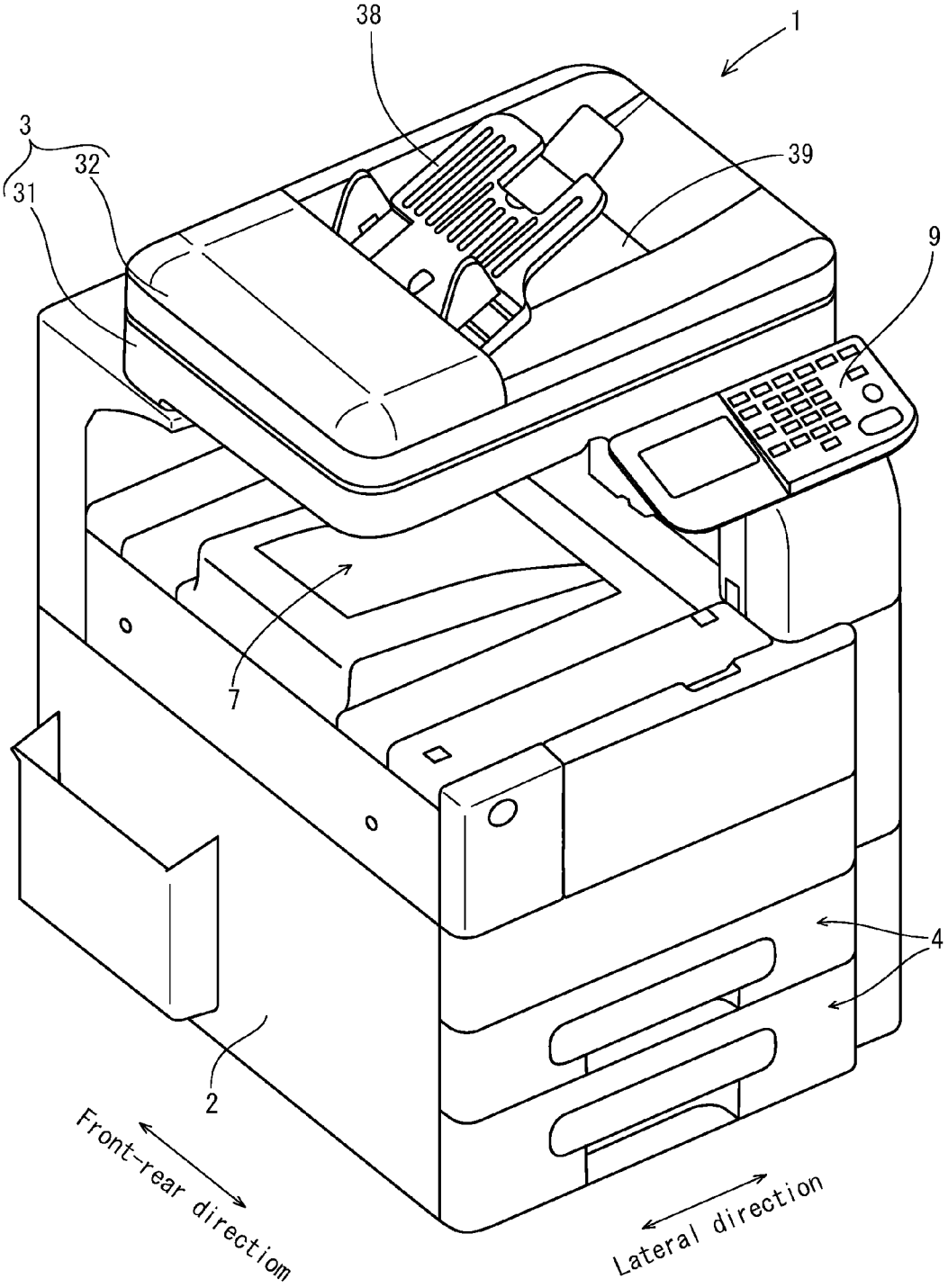
FIG. 1 is an outer perspective view of an image forming apparatus according to an embodiment.

An overall configuration of an image forming apparatus common to all the embodiments described below will be described by referring to the drawings. FIG. 1 is an outer perspective view of an image forming apparatus according to an embodiment, and FIG. 2 is a schematic view of an internal configuration of the image forming apparatus.

As shown in FIGS. 1 and 2, an image forming apparatus 1 includes an image reader 3, a sheet feed tray 4, a transfer unit 5, a fixing unit 6, a collection tray 7, and an operation panel 9. The image reader 3 reads an image on a document P1. The sheet feed tray 4 stores a recording sheet P2, on which an image is to be formed. The transfer unit 5 transfers an image onto the recording sheet P2 fed from the sheet feed tray 4. The fixing unit 6 fixes a toner image transferred at the transfer unit 5 onto the recording sheet P2. On the collection tray 7, the recording sheet P2 on which the image has been formed at the transfer unit 5 is discharged. The operation panel 9 receives an operation intended for the image forming apparatus 1. The image reader 3 is disposed in an upper portion of a main body 2 of the image forming apparatus 1, and the transfer unit 5 is disposed below the image reader 3.

The collection tray 7 is disposed above the transfer unit 5 in the main body 2 to receive the discharged recording sheet P2 on which an image has been formed at the transfer unit 5 and at the fixing unit 6. The sheet feed tray 4 is disposed below the transfer unit 5 in the main body 2 in an attachable and detachable manner. Thus, in this configuration, the recording sheet P2 stored in the sheet feed tray 4 is fed into the main body 2, and then is conveyed upward. An image is transferred onto the recording sheet P2 in the transfer unit 5, which is disposed above the sheet feed tray 4, and then is fixed in the fixing unit 6. Then, the recording sheet P2 is discharged onto the collection tray 7 disposed in the space (recessed space) defined between the image reader 3 and the transfer unit 5.

The image reader 3, which is disposed above the main body 2, includes a scanner 31 and an auto document feeder (ADF) 32. The scanner 31 reads the image on the document P1. The ADF 32 is disposed above the scanner 31 and conveys one of the documents P1 at a time to the scanner 31. The operation panel 9 is disposed on a front side (forward side) of the main body 2. A user operates the keys by referring to the display screen and other elements on the operation panel 9 when the user executes various kinds of setting of a function selected from the various functions of the image forming apparatus 1, and instructs the image forming apparatus 1 to execute processing.

Next, an internal structure of the main body 2 will be described by referring to FIG. 2. The scanner 31 of the image reader 3 above the main body 2 includes a platen 33, a light source device 34, an image sensor 35, an imaging lens 36, and a mirror group 37. The platen 33 has a platen glass (not shown) on an upper surface side. The light source device 34 radiates light onto the document P1. The image sensor 35 performs photoelectric conversion of reflected light from the document P1 into image data. The imaging lens 36 images the reflected light on the image sensor 35. The mirror group 37 sequentially reflects the reflected light from the document P1 so that the reflected light is incident on the imaging lens 36. The light source device 34, the image sensor 35, the imaging lens 36, and the mirror group 37 are disposed in the platen 33. The light source device 34 and the mirror group 37 are movable in left and right directions with respect to the platen 33.

On the upper surface side of the scanner 31, the ADF 32 is openably disposed on the platen 33. The ADF 32 has a function of holding the document P1 on the platen glass (not shown) by being laid on the document P1 on the platen glass (not shown) of the platen 33. The ADF 32 includes a document placement tray 38 and a document collection tray 39.

When the image reader 3 with the above-described configuration reads the document P1 on the platen glass (not shown) of the platen 33, the document P1 is irradiated with light from the light source device 34 moving rightward (in a sub scanning direction). The reflected light from the document P1 is sequentially reflected by the mirror group 37 moving in the same direction as the light source device 34, that is, rightward. Thus, the reflected light is incident on the imaging lens 36 and is imaged on the image sensor 35. The image sensor 35 performs photoelectric conversion with respect to each pixel in accordance with the intensity of the incident light to generate an image signal (RGB signal) corresponding to the image on the document P1.

When the image reader 3 reads the document P1 placed on the document placement tray 38, the document P1 is conveyed to a reading position by a document conveyance mechanism 40, which is made up of a plurality of rollers and other elements. Here, the light source device 34 and the mirror group 37 of the scanner 31 are secured at predetermined positions in the platen 33. Thus, the light is radiated onto a portion of the document P1 at the reading position, and the reflected light is imaged on the image sensor 35 through the mirror group 37 and the imaging lens 36 in the scanner 31. The image sensor 35 converts the reflected light into an image signal (RGB signal) corresponding to the image on the document P1. Then, the document P1 is discharged onto the document collection tray 39.

The transfer unit 5, which transfers a toner image onto the recording sheet P2, includes image forming devices 51, exposure devices 52, an intermediate transfer belt 53, primary transfer rollers 54, a drive roller 55, a driven roller 56, a secondary transfer roller 57, and a cleaner 58. The image forming devices 51 respectively generate yellow (Y), magenta (M), cyan (C), and key tone (K) toner images. The exposure devices 52 are disposed below the image forming devices 51. The intermediate transfer belt 53 comes into contact with the image forming devices 51 of the respective colors arranged in a horizontal direction. Thus, the toner images of the respective colors are transferred onto the intermediate transfer belt 53. The primary transfer rollers 54 are disposed above and in opposition to the respective image forming devices 51 in such a manner that the primary transfer rollers 54 and the image forming devices 51 sandwich the intermediate transfer belt 53. The drive roller 55 drivingly rotates the intermediate transfer belt 53. The driven roller 56 is drivingly rotated when the rotation of the drive roller 55 is transmitted to the driven roller 56 through the intermediate transfer belt 53. The secondary transfer roller 57 is disposed in opposition to the driving roller 55 with the intermediate transfer belt 53 interposed between the secondary transfer roller 57 and the driving roller 55. The cleaner 58 is disposed in opposition to the driven roller 56 with the intermediate transfer belt 53 interposed between the cleaner 58 and the driven roller 56.

Each of the image forming devices 51 includes a photoreceptor drum 61, a charger 62, a developer 63, and a cleaner 64. The photoreceptor drum 61 comes into contact with an outer peripheral surface of the intermediate transfer belt 53. The charger 62 charges an outer peripheral surface of the photoreceptor drum 61 by corona charging. The developer 63 causes the stirred and charged toner to be attached onto the outer peripheral surface of the photoreceptor drum 61. The cleaner 64 removes the toner remaining on the outer peripheral surface of the photoreceptor drum 61 after the toner image has been transferred onto the intermediate transfer belt 53. The photoreceptor drum 61 is disposed in opposition to the primary transfer roller 54 with the intermediate transfer belt 53 interposed between the photoreceptor drum 61 and the primary transfer roller 54, and rotates in the clockwise direction of FIG. 3. Around the photoreceptor drum 61, the primary transfer roller 54, the cleaner 64, the charger 62, the exposure unit 52, and the developer 63 are arranged in this order in the rotational direction of the photoreceptor drum 61.

The intermediate transfer belt 53 is a conductive endless belt, for example. The intermediate transfer belt 53 is tightly wound across the driving roller 55 and the driven roller 56. Thus, the intermediate transfer belt 53 is drivingly rotated in the counter clockwise direction in FIG. 2 by the rotation of the driving roller 55. Around the intermediate transfer belt 53, the secondary transfer roller 57, the cleaner 58, and the image forming devices 51 of YMCK colors are arranged in this order in the rotational direction of the intermediate transfer belt 53.

The fixing unit 6, which fixes the toner image transferred onto the recording sheet P2, includes a heating roller 59 and a pressing roller 60. The heating roller 59 includes a halogen lamp or a similar element that performs heating so that the toner image on the recording sheet P2 is fixed. The pressing roller 60 holds and presses the recording sheet P2 together with the heating roller 59. A surface of the heating roller 59 may be heated by producing an eddy current on the surface by electromagnetic induction.

The feeding mechanism 8 includes a pick-up roller 81 and a pair of separating rollers including a sheet feed roller 82 and a separation roller 83. The pick-up roller 81 picks up the uppermost part of the recording sheets P2 in the sheet feed tray 4. The pair of separating rollers separate the picked part of recording sheets P2 into individual sheets. The recording sheet P2 from the sheet feed tray 4 is sent to the main conveyance path R0 through a sheet feed path R1 starting from the uppermost sheet by the driving rotation of the sheet feed roller 82 and the separation roller 83. The main conveyance path R0 serves as a main path through which the recording sheets P2 are subjected to image forming (printing) processing. The sheet feed path R1 is provided for each sheet feed tray 4, and each sheet feed path R1 joins the main conveyance path R0.

A manual feeding tray 93 is disposed on one side portion of the main body 2 in left and right directions (right in this embodiment). A recording sheet P2 of a predetermined size can be fed from the outside through the manual feeding tray 93. The manual feeding tray 93 is an additional tray provided separately from the standard sheet feeding device 4 in the main body 2, and is rotatably attached to the one side portion of the main body 2 to be opened and closed. The recording sheet P2 on the manual feeding tray 93 are sent to the main conveyance path R0 through a manual feed path R2; one recording sheet P2 is sent at a time, starting from the uppermost sheet by the driving rotation of a pick-up roller and other elements.

A portion of the main conveyance path R0 between the intermediate transfer belt 53 and the secondary transfer roller 57 in the transfer unit 5 (contact portion) is a secondary transfer nip portion as a secondary transfer area. A separation claw 70, which has a distal end in contact with the intermediate transfer belt 53, is disposed at a position above the driving roller 55, which is on the downstream side of the secondary transfer nip portion. A static charge eliminator 71, which has a saw tooth form, is disposed in opposition to the separation claw 70 across the main conveyance path R0, that is, the static charge eliminator 71 is disposed above the secondary transfer roller 57. The static charge eliminator 71 comes into contact with the recording sheet P2 past the secondary nip portion to remove the static charge.

Conveyance guides 72*a* and 72*b* are disposed at positions that are further downstream than the second transfer nip portion, which is defined between the intermediate transfer belt 53 and the second transfer roller 57. The conveyance guides 72*a* and 72*b* guide the recording sheet P2 to the fixing unit 6. The conveyance guides 72*a* and 72*b* are respectively disposed on left and right sides of a portion of the main conveyance path R0, between the transfer unit 5 and the fixing unit 6. At positions further downstream than the fixing unit 6 (that is, at positions above the fixing unit 6) in the main conveyance path R0, conveyance guides 73*a* and 73*b* are respectively disposed on left and right sides of the main conveyance path R0. A pair of discharge rollers 91 are disposed at an end portion of the main conveyance path R0, that is, at a most downstream portion of the main conveyance path R0. The pair of discharge rollers 91 are drivingly rotated to discharge the printed recording sheet P2 onto the collection tray 7.

Axial flow fans 76 are disposed in an area of space that is above the intermediate transfer belt 53 and further left than the conveyance guide 72*a*. The fans 76 send air to the conveyance guide 72*a*. This causes a flow of air in the conveyance path R0, which is defined between the conveyance guides 72*a* and 72*b* from the upstream side to the downstream side in the conveyance direction of the recording sheet P2. The flow of air thus produced in the conveyance path R0 by the air sent from the fans 76 prevents a swirl current from occurring associated with the conveyance of the recording sheet P2.

The printing operation of the image forming apparatus 1 will be briefly described. The image forming apparatus 1 starts the printing operation upon receiving a start signal, an image signal, or some other signal. When the printing operation starts, the recording sheet P2 picked up from the sheet feed tray 4 by the feeding mechanism 8 is conveyed along the main conveyance path R0 to the transfer unit 5. The transfer unit 5 and the fixing unit 6 transfer and fix an image on the recording sheet P2 based on color electrophotography. An intermediate transfer method using the intermediate transfer belt 53 is employed as a method of transferring an image onto the recording sheet P2.

Here, in each of the image forming devices 51 of the respective Y, M, C, and K colors in the transfer unit 5, the surface of the photoreceptor drum 61 charged by the charger 62 is irradiated with laser light from the exposure unit 52. Thus, an electrostatic latent image of a corresponding one of Y, M, C, and K colors is formed on the surface. In the developer 63, the charged toner is transferred onto the surface of the photoreceptor drum 61 having the electrostatic latent image formed. Thus, a toner image is formed on the photoreceptor drum 61. The toner image carried on the surface of the photoreceptor drum 61 is transferred onto the intermediate transfer belt 53 by electrostatic force of the primary transfer roller 54 when the surface comes into contact with the intermediate transfer belt 53. Thus, a toner image with the Y, M, C, and K colors superimposed one on top of each other is formed on the surface of the intermediate transfer belt 53. Un-transferred toner remaining on the photoreceptor drum 61 after the toner image is transferred onto the intermediate transfer belt 53 is scrapped off the photoreceptor drum 61 by the cleaner 64.

The toner image transferred on the intermediate transfer belt 53 moves to a transfer position where the secondary transfer roller 57 and the intermediate transfer belt 53 come into contact with each other, as the driving roller 55 and the driven roller 56 rotate the intermediate transfer belt 53. Thus, the toner image is transferred onto the recording sheet P2 conveyed to the transfer position on the main conveyance path R0. The un-transferred toner remaining on the intermediate transfer belt 53 after the toner image is transferred onto the recording sheet P2 is scraped off by the cleaner 58 to be removed from the intermediate transfer belt 53.

After the recording sheet P2 has received transfer of the toner image at the position in contact with the second transfer roller 57, the static charge eliminator 71 comes into contact with the recording sheet P2 on the surface (hereinafter simply referred to as "back surface") opposite the surface (hereinafter referred to as "image formation surface") on which the image is formed. Thus, the static charges are eliminated. Then, the recording sheet P2 is conveyed to the fixing unit 6, which is made up of the heating roller 59 and the pressing roller 60. The recording sheet P2 loaded with the unfixed toner image on the image formation surface passes through the fixing nip portion in the fixing unit 6; in the meantime, the recording sheet P2 is heated by the heating roller 59 and pressed by the pressing roller 60. Thus, the unfixed toner image is fixed on the sheet surface. The recording sheet P2 having the toner image fixed (having one surface printed) is conveyed to the pair of discharge rollers 91 by the conveyance guides 73*a* and 73*b*, and then is discharged to the collection tray 7 by the pair of discharge rollers 91.

The image forming apparatuses according to the embodiments described below have in common the above-described configuration of the image forming apparatus 1, and are different from each other in the configuration of a portion located further downstream than the transfer unit 5 in the conveyance path R0. Thus, in each of the embodiments described below, the configuration of the portion located further downstream than the transfer unit 5 in the conveyance path R0 will be described in detail.

First Embodiment

Figure 3:
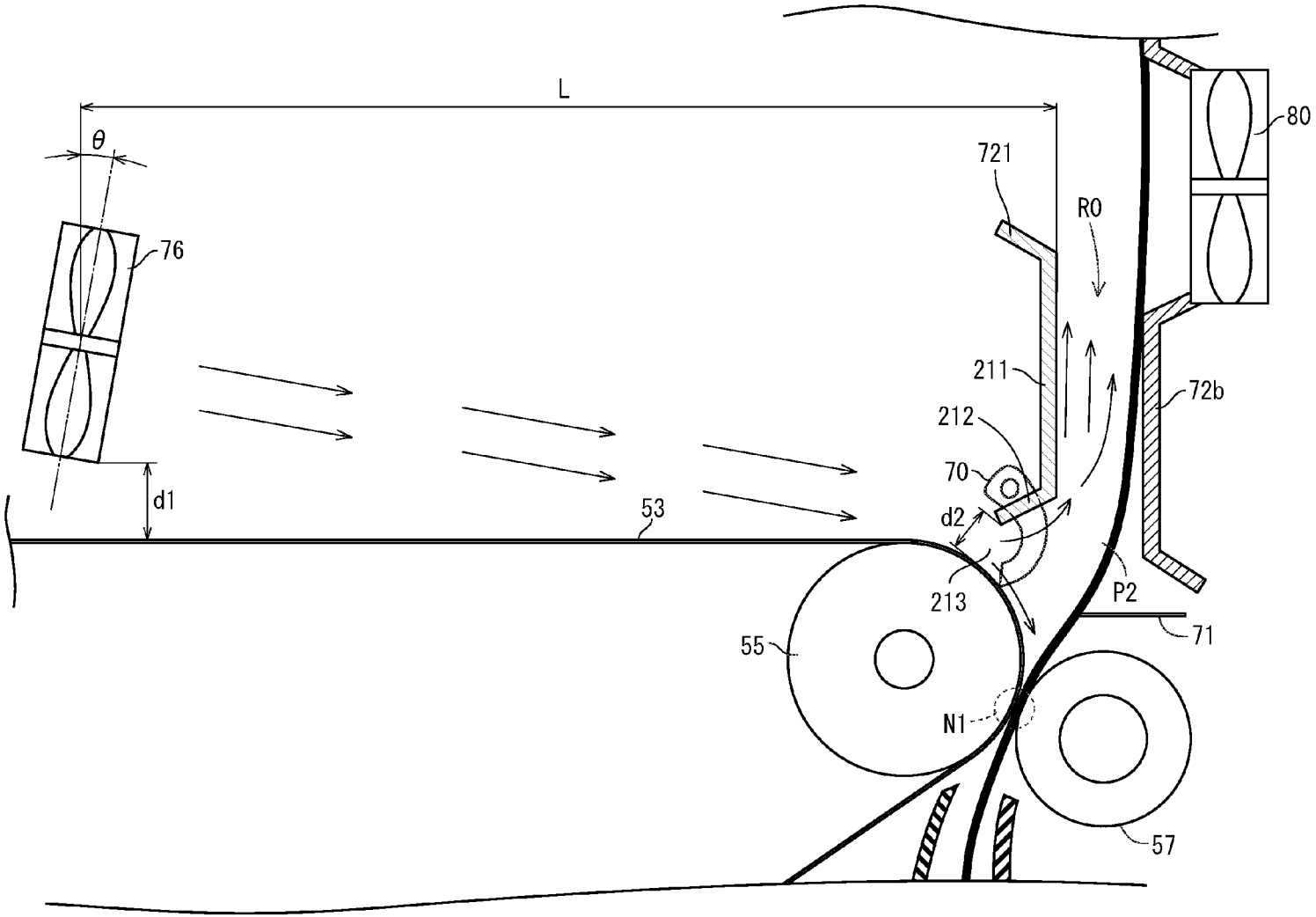
FIG. 3 is a schematic cross-sectional view of a configuration of a portion of an image forming apparatus according to a first embodiment of the present invention that is further downstream than a transfer unit.

An image forming apparatus according to the first embodiment of the present invention will be described below by referring to the drawings. FIG. 3 is a schematic cross-sectional view of a configuration of a portion of the image forming apparatus according to this embodiment that is further downstream than the transfer unit. The overall configuration of the image forming apparatus according to this embodiment is as shown in FIGS. 1 and 2.

As shown in FIG. 3, the image forming apparatus 1 according to this embodiment includes a guide member 721 as a part of the conveyance guide 72*a* (see FIG. 2). The guide member 721 is disposed at a position on the main conveyance path R0 that is adjacent to a downstream portion of the transfer unit 5. The guide member 721 includes a sheet guide portion 211, which faces the conveyance guide 72*b*. A distal end portion 212 of the guide member 721 is further upstream in the recording sheet conveyance direction than the sheet guide portion 211, and is bent toward the upper surface of the intermediate transfer belt 53. Specifically, the distal end portion 212 of the guide member 721 extends from the sheet guide portion 211 toward a position that is further downstream in the rotation direction of the driving roller 55 than the transfer nip area (secondary nip portion) N1, which is on the outer periphery of the driving roller 55.

In this configuration of the guide member 721, the sheet guide portion 211 of the guide member 721 is disposed at a position that is further inside of the main conveyance path R0 than the position at which the recording sheet P2 is separated by the separation claw 70. The distal end portion 212 of the guide member 721 is disposed at a position that is further outside of the main conveyance path R0 than the position at which the recording sheet P2 is separated by the separation claw 70. Thus, the recording sheet P2 separated from the intermediate transfer belt 53 by the separation claw 70 is smoothly guided toward the upstream side in the conveyance direction along the sheet guide portion 211 of the guide member 721, without contacting the distal end portion 212 of the guide member 721.

Figure 4:
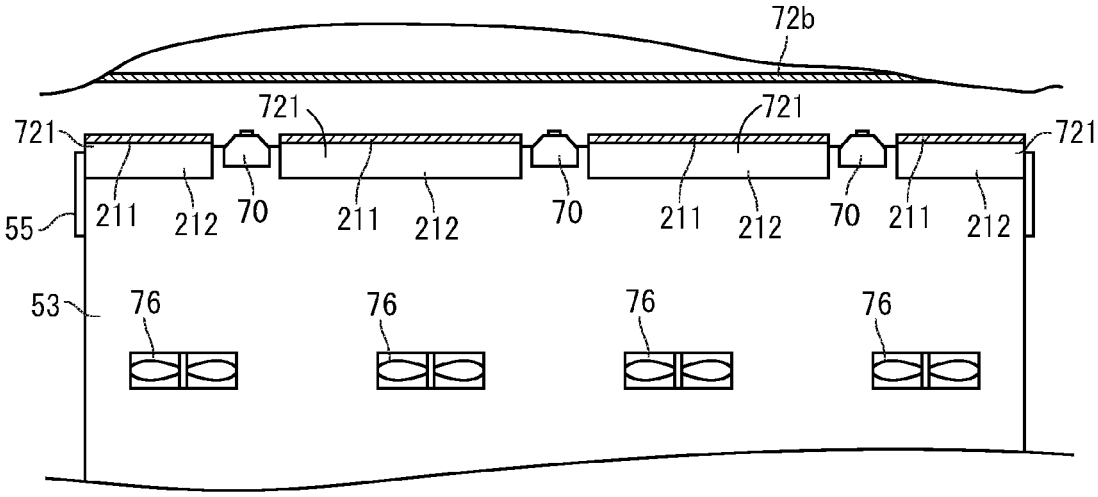
FIG. 4 is a plan view of a configuration of a portion of the transfer unit of the image forming apparatus according to the first embodiment of the present invention that is adjacent to a main conveyance path.

As shown in FIGS. 3 and 4, a plurality of fans 76 are disposed at positions that are above the intermediate transfer belt 53 and separated from the sheet guide portion 211 of the guide member 721 by a distance L. The fans 76 are aligned at equal intervals in a direction orthogonal to the rotation direction of the intermediate transfer belt 53, and send air to the guide member 721. Each fan 76 has its lower end positioned at a height d1 from the upper surface of the intermediate transfer belt 53.

The air sending surface of the fan 76 is orthogonal to the upper surface of the intermediate transfer belt 53 or inclined toward the driving roller 55. The state in which the air sending surface of the fan 76 is orthogonal to the upper surface of the intermediate transfer belt 53 is defined as a state where an inclination angle θ of the fan 76 is 0 degrees. The air sending surface of the fan 76 becomes inclined by greater degrees toward the intermediate transfer belt 53 as the inclination angle θ increases.

Thus, the fans 76 are disposed above the intermediate transfer belt 53 as described above. Here, the lower end of the distal end portion 212 of the guide member 721 is separated from the surface of the intermediate transfer belt 53 by a distance d2, and thus a gap 213 is defined between the intermediate transfer belt 53 and the distal end portion 212. The air sent from the fan 76 produces a flow of air in a direction (toward the guide member 721) opposite the rotation direction of the intermediate transfer belt 53. Thus, air flows into the main conveyance path R0 through the gap 213, which is defined between the guide member 721 and the intermediate transfer belt 53.

The flow of air into the main conveyance path R0 through the gap 213 offsets the flow of air produced in the movement direction of the intermediate transfer belt 53. Even though the flow of air toward the downstream side in the conveyance direction is produced in the main conveyance path R0 as the recording sheet P2 moves, the flow of air through the gap 213 prevents negative pressure at a portion adjacent to the downstream side of the transfer nip area N1. As described above, the fan 76 sends air to produce a flow of air to the main conveyance path R0 through the gap 213. This causes a flow of air in the movement direction of the recording sheet P2 in the main conveyance path R0, and additionally, prevents a swirling current from occurring on the downstream side of the transfer nip portion N1. This prevents flowing toner and other substances from attaching to the sheet guide portion 211 of the guide member 721. Additionally, the recording sheet P2 is away from the sheet guide portion 211 while being conveyed. This prevents generation of noise in the image formed on the recording sheet P2.

Here, when the interval (length) d2 of the gap 213, which is defined between the guide member 721 and the intermediate transfer belt 53, is shorter than the distance d1 between the fan 76 and the intermediate transfer belt 53, the amount of flow of air to the main conveyance path R0 through the gap 213 increases by setting the inclination angle θ of the fan 76 to be larger than 0 degrees. Specifically, with the fan 76 inclined toward the intermediate transfer belt 53, a large amount of air flows to the main conveyance path R0 through the gap 213, which is positioned lower than the fan 76.

A suction fan 80 is disposed on the downstream side of the conveyance guide 72*b*. The suction fan 80 sucks the air in the main conveyance path R0 and discharges the air to the outside of the apparatus main body 2 (see FIG. 2). Although not elaborated in the figure, a toner filter is disposed on the airflow path from the suction fan 80 to the outside of the apparatus main body 2. The toner filter collects powder dust such as scattered toner. The suction fan 80 sucks the air in the main conveyance path R0, and thus the recording sheet P2 is sucked to the side of the conveyance guide 72*b*. This prevents the recording sheet P2 from contacting the guide member 721, and additionally, causes powder dust such as scattered toner in the main conveyance path R0 to be collected.

In the configuration described above, the guide member 721 and the fan 76 are arranged in such a manner that the distance L between the guide member 721 and the fan 76 is set at approximately 220 mm, the distance d1 between the fan 76 and the intermediate transfer belt 53 is set at approximately 15 mm, and the length d2 of the gap 213 from the guide member 721 is set at approximately 10 mm. Here, when the inclination angle θ of the fan 76 is 0 degrees, it is necessary send a large amount of air from the fan 76 so as to obtain a sufficient amount of flow of air in the main conveyance path R0. When the inclination angle θ of the fan 76 is set to be larger than 0 degrees, a sufficient amount of flow of air in the main conveyance path R0 is obtained even when the amount of air sent from the fan 76 is not large.

That is, the flow of air in the main conveyance path R0 becomes optimum when the above-described positional relationship between the fan 76 and the guide member 721 is such that the fan 76 is inclined at an inclination angle θ in the range between 0 degrees to 20 degrees. The flow of air in the main conveyance path R0 is further optimized when the fan 76 is inclined at an inclination angle θ of approximately 10 degrees. Thus, by inclining the fan 76, a sufficient amount of flow of air occurs in the main conveyance path R0 with a small amount of air sent from the fan 76. The amount of the air sent from the fan 76 is set to be smaller than the amount of air sucked by the suction fan 80.

With the fan 76 installed in the above-described posture, air flows in the main conveyance path R0 in the conveyance direction of the recording sheet P2. This prevents flowing toner and other substances from attaching to the guide member 721 and the separation claw 70. Furthermore, the flow of air through the gap 213, which is defined between the guide member 721 and the intermediate transfer belt 53, generates an air layer between the recording sheet P2 loaded with the transferred toner image and the guide member 721 and the separation claw 70. This prevents the recording sheet P2 from contacting the guide member 721 and the separation claw 70. This, in turn, eliminates or minimizes image noise on the recording sheet P2 on the downstream side of the transfer nip area N1.

Second Embodiment

Figure 5:
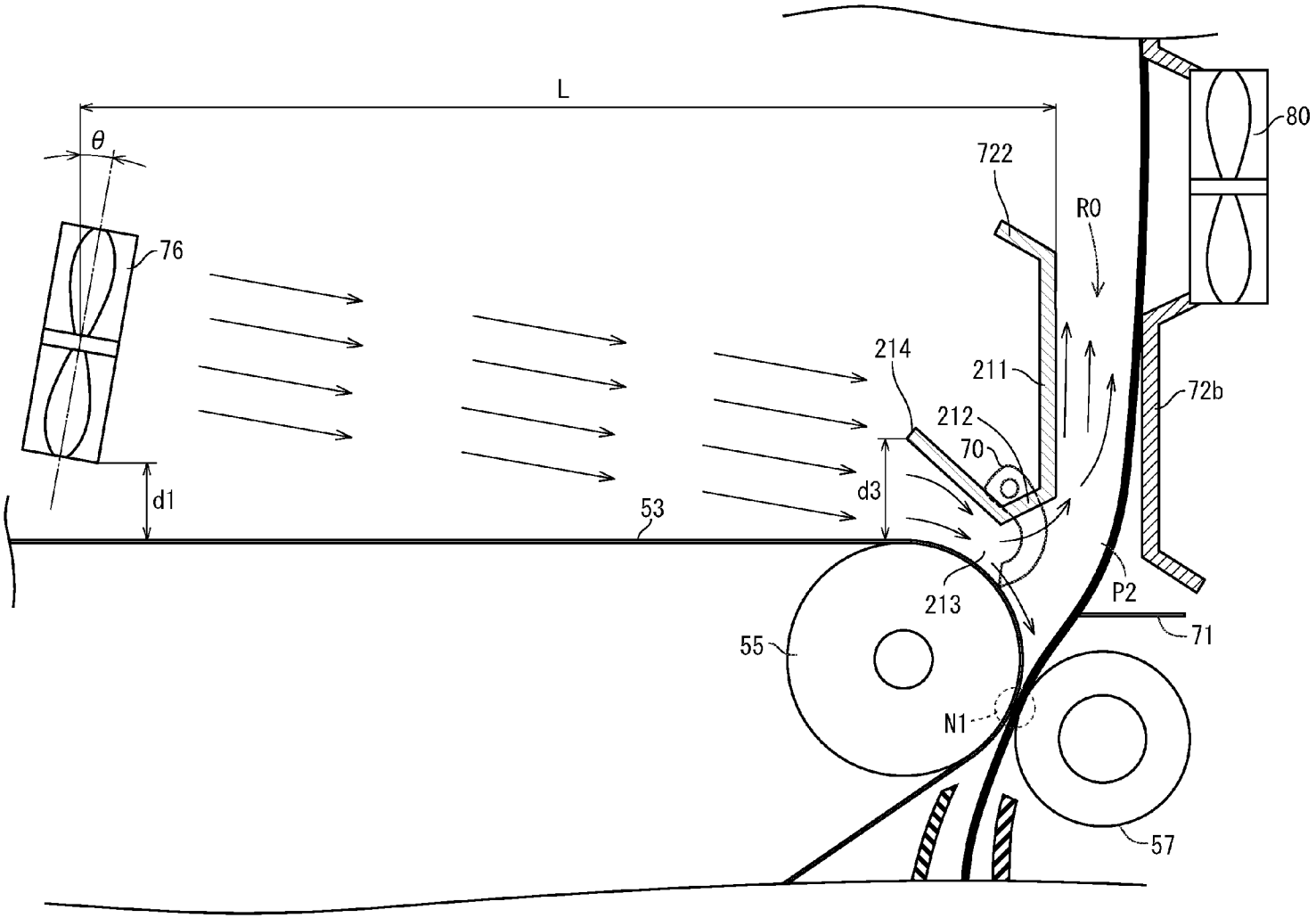
FIG. 5 is a schematic cross-sectional view of a configuration of a portion of an image forming apparatus according to a second embodiment of the present invention that is further downstream than the transfer unit.

An image forming apparatus according to the second embodiment of the present invention will be described below by referring to the drawings. FIG. 5 is a schematic cross-sectional view of a configuration of a portion of the image forming apparatus according to this embodiment that is further downstream than the transfer unit. In the configuration shown in FIG. 5, the components that are the same as the counterparts in FIG. 3 are denoted with the same reference numerals and will not be elaborated here.

As shown in FIG. 5, the image forming apparatus 1 according to this embodiment includes, as a part of the conveyance guide 72*a* (see FIG. 2) in the main conveyance path R0 adjacent to and on the downstream side of the transfer unit 5, a guide member 722 instead of the guide member 721 (see FIG. 3) according to the first embodiment. The guide member 722 includes an air guide portion 214, which extends from the distal end portion 212 to the side of the fan 76. Specifically, the guide member 722 according to this embodiment includes the air guide portion 214, which extends from the distal end portion 212, in addition to the configuration that is the same as the guide member 721 according to the first embodiment, in which the sheet guide portion 211 and the distal end portion 212 are disposed.

The air guide portion 214 of the guide member 722 extends from the lower end of the distal end portion 212 along the rotation direction of the intermediate transfer belt 53. The air guide portion 214 moves away from the upper surface of the intermediate transfer belt 53 as the air guide portion 214 approaches the fan 76. Here, the distal end of the air guide unit 214 on the side of the fan 76 is at a height d3 from the intermediate transfer belt 53. The height d3 is higher than the height d1 of the lower end of the fan 76. When the guide member 722 is provided with the air guide portion 214 of this configuration, the air guide portion 214 is able to guide a large portion of the air sent to the guide member 722 by the fan 76 to the gap 213 between the distal end portion 212 and the intermediate transfer belt 53.

Specifically, when the fans 76 are driven during the printing operation (image forming) on the recording sheet P2, the fans 76 send the air above the intermediate transfer belt 53 to the guide member 722, and a large portion of the air flows between the air guide portion 214 and the intermediate transfer belt 53. Thus, the amount of the air that passes through the gap 213 between the distal end portion 212 of the guide member 722 and the intermediate transfer belt 53 is larger than the amount of air in the configuration of the first embodiment. Thus, the amount of the air that flows to the main conveyance path R0 through the gap 213 increases. This more reliably reduces attachment of flowing toner to the guide member 722 and the separation claw 70 than in the configuration of the first embodiment, while at the same time reliably preventing the recording sheet P2 from contacting the guide member 722 and the separation claw 70.

In the configuration described above, the guide member 722 and the fan 76 are arranged in such a manner that the distance L between the guide member 722 and the fan 76 is set at approximately 220 mm, the distance d1 between the fan 76 and the intermediate transfer belt 53 is set at approximately 15 mm, and the height d3 of the end portion (opening side end portion) of the air guide portion 214 of the guide member 722 on the side of the fan 76 is set at approximately 20 mm. Here, a sufficient amount of air is obtained in the main conveyance path R0 with the fan 76 at an inclination angle θ of 0 degrees, even when the amount of the air sent from the fan 76 is smaller than the amount of the air in the first embodiment. When the inclination angle θ of the fan 76 is larger than 0 degrees, a sufficient amount of air is obtained in the main conveyance path R0, even when the amount of the sent air is smaller than in the case where the inclination angle θ of the fan 76 is 0 degrees.

As has been described hereinbefore, the guide member 722 in this embodiment is capable of guiding the flow of air from the fan 76 to the main conveyance path R0 more efficiently than the guide member 721 according to the first embodiment (see FIG. 3). This reduces the amount of the air sent from the fans 76. This, in turn, not only reduces power consumption at the fans 76 but also reduces noise involved in the driving of the fans 76. Employing the configuration of this embodiment reduces the number of the fans 76 as compared with the configuration of the first embodiment, or reduces the sizes of the fans 76 in providing the same advantageous effects provided in the first embodiment.

Third Embodiment

Figure 6:
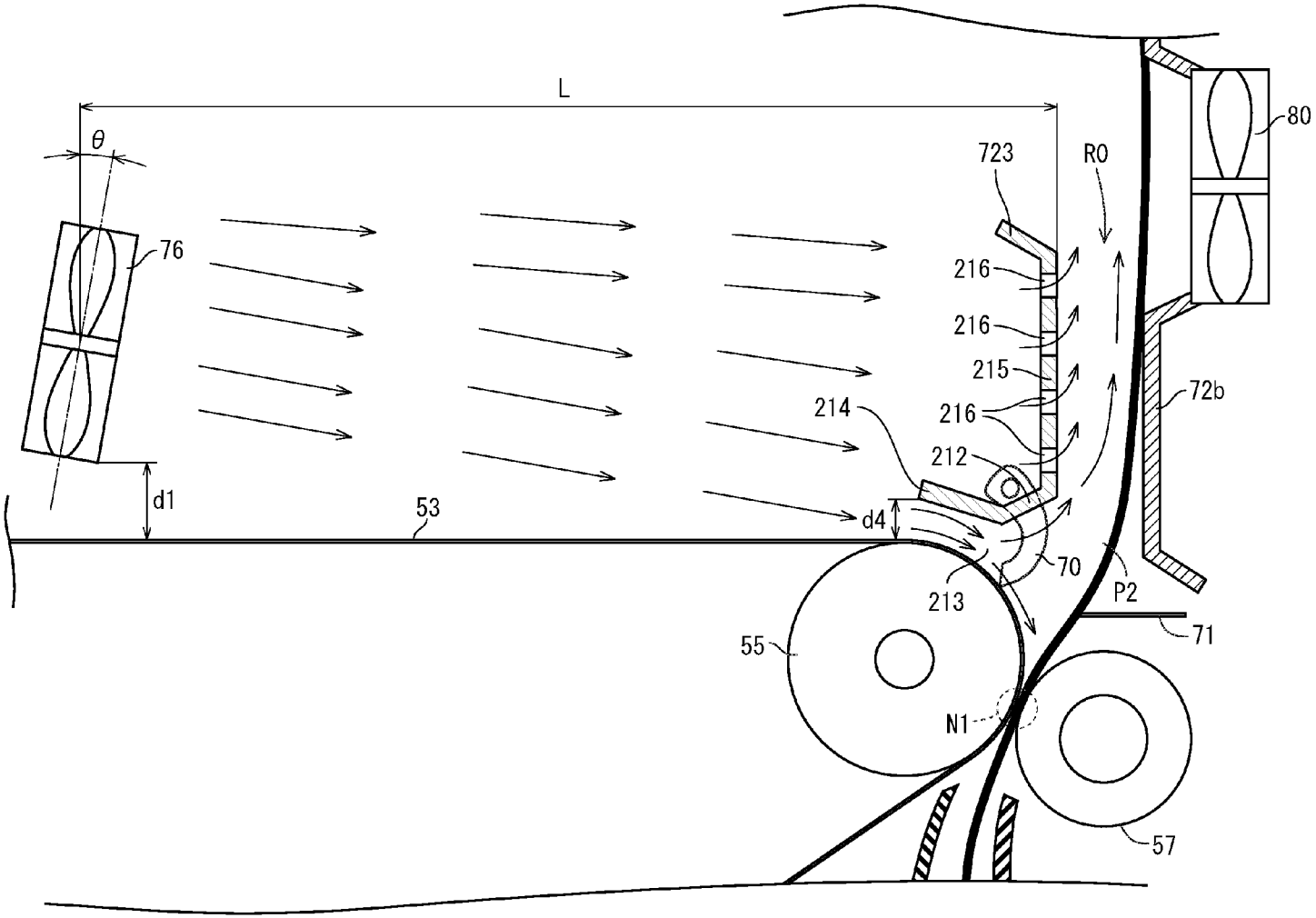
FIG. 6 is a schematic cross-sectional view of a configuration of a portion of an image forming apparatus according to a third embodiment of the present invention that is further downstream than the transfer unit.

An image forming apparatus according to the third embodiment of the present invention will be described below by referring to the drawings. FIG. 6 is a schematic cross-sectional view showing a configuration of a portion of the image forming apparatus according to this embodiment that is further downstream than the transfer unit. In the configuration shown in FIG. 6, the components that are the same as the counterparts in FIG. 5 are denoted with the same reference numerals and will not be elaborated here.

Figure 7:
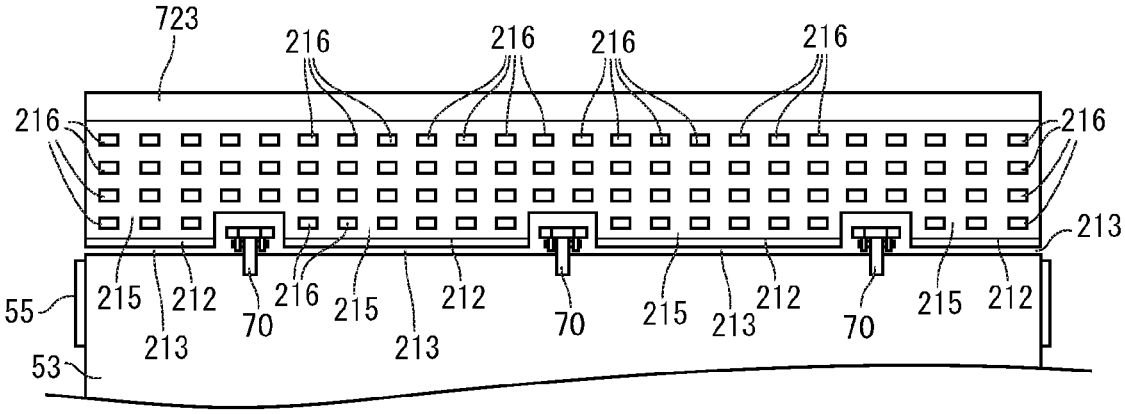
FIG. 7 is a schematic view of a configuration of a sheet guide portion in a guide member shown in FIG. 6.

As shown in FIG. 6, the image forming apparatus 1 according to this embodiment includes, as a part of the conveyance guide 72*a* (see FIG. 2) in the main conveyance path R0 adjacent to and on the downstream side of the transfer unit 5, a guide member 723 instead of the guide member 722 (see FIG. 3) in the second embodiment. The guide member 723 includes a sheet guide portion 215. The sheet guide portion 215 includes a plurality of air holes 216 and thus has a multi-hole structure. Specifically, the guide member 723 according to this embodiment includes the sheet guide portion 215, in which the air holes 216 are arranged in matrix as shown in FIG. 7, instead of the sheet guide portion 211, in addition to the configuration that is the same as the guide member 722 according to the second embodiment.

Since the sheet guide portion 215 includes the air holes 216 as described above, the air above the intermediate transfer belt 53 sent to the guide member 723 by the fan 76 flows into the main conveyance path R0 not only through the gap 213 between the distal end portion 212 and the intermediate transfer belt 53, but also through the air holes 216. Employing the configuration of this embodiment with the guide member 723 increases the amount of the air that flows into the main conveyance path R0, as compared with the configuration of the second embodiment.

The air guide portion 214 is at a height d4 from the intermediate transfer belt 53, and the height d4 may be lower than the height d3 of the air guide portion 214 of the guide member 722 according to the second embodiment. Thus, the air guide member 214 is shorter in the guide member 723 than in the guide member 722, and this simplifies the configuration of the air guide member 214. The air guide member 214 of the guide member 723 is lower in height, d4, and thus does not hinder the flow of air from the fans 76 to the air hole 216. This ensures that air efficiently flows through the air hole 216 to the main conveyance path R0.

In the configuration described above, the guide member 723 and the fans 76 are arranged in such a manner that the distance L between the guide member 723 and the fan 76 is set at approximately 220 mm, the distance d1 between the fan 76 and the intermediate transfer belt 53 is set at approximately 15 mm, and the height d4 of the of the end portion (opening side end portion), on the side of the fan 76, of the air guide portion 214 of the guide member 723 is set at approximately 8 mm. Here, even when the inclination angle θ of the fan 76 is 0 degrees, a more sufficient amount of air is obtained in the main conveyance path R0 as compared with the second embodiment. When the inclination angle θ of the fan 76 is larger than 0 degrees, the flow of air in the main conveyance path R0 is more efficiently produced than in the second embodiment.

As has been described hereinbefore, the guide member 723 according to this embodiment is capable of allowing air to flow into the main conveyance path R0 from the intermediate transfer belt 53 more efficiently than the guide member 722 (see FIG. 5) according to the second embodiment. This provides greater freedom on setting of the inclination angle of the fan 76, and further reduces the amount of the air sent from the fan 76. This, in turn, further reduces power consumption at the fans 76 and noise involved in the driving of the fans 76.

While in this embodiment the air holes 216, which are disposed in the sheet guide portion 215, are arranged in a matrix, any of other configurations is possible. For example, slit shaped air holes that are elongate in a direction orthogonal to the conveyance direction of the recording sheet P2 may be arranged along the conveyance direction of the recording sheet P2. The shape of the air hole 216 is not limited to the above-described rectangular shape; any other shape is possible, such as a circular shape and an oval shape.

The exemplary values L, d1 to d4, and θ, which indicate arrangement states of the fans 76 and the guide members 721 to 723, should not be construed as limiting values to provide the above-described advantageous effects according to the embodiments. In making the air sending surface of the fan 76 inclined toward the gap 213, it is possible to change the exemplary values conveniently so as to, for example, determine an optimum inclination angle of the fans 76 in accordance with the positional relationship between the fans 76 and the guide members 721 to 723.

In the above-described embodiments, the fans 76, which provide flows of air in the main conveyance path R0, may be driven when the recording sheet P2 loaded with a toner image passes through the main conveyance path R0. Alternatively, the fans 76 may be constantly driven during the image forming operation on the recording sheet P2. The suction fan 80 is preferably driven constantly during the image forming operation on the recording sheet P2, in order to maintain the posture of the conveyed recording sheet P2 in the main conveyance path R0, and in order to collect powder dust.

An image forming apparatus according to any of the above-described embodiments may be any of a printer, a copier, a fax machine, and a multi-function machine (MFP) integrally incorporating copy, scanner, printer, and fax capabilities, insofar as the sheet feeder and the feeding mechanism in any of the embodiments are included. Moreover, the location or arrangement of individual elements in the illustrated embodiments should not be construed in a limiting sense. Various modifications can be made without departing from the scope of the present invention.

In the above-described embodiments, air flows into the conveyance path through the gap between the transfer unit and the conveyance guide member, and flows from the upstream side to the downstream side in the recording sheet conveyance direction in the conveyance path. This eliminates or minimizes attachment of flowing toner and other substances to the conveyance guide member and the separation claw. The air flows in the conveyance path in the same direction as the conveyance direction of the recording sheet. This eliminates or minimizes occurrence of a swirling current associated with the air flowing in the conveyance path, and thus eliminates or minimizes swirling up of powder dust such as flowing toner. Furthermore, since the air flows over the image formation surface of the recording sheet conveyed in the conveyance path, the recording sheet is prevented from coming into contact with the conveyance guide member and other members. This reduces image noise on the recording sheet loaded with an image on the downstream side of the transfer nip area.

Obviously, numerous modifications and variations of the present disclosure are possible in light of the above teachings. It is therefore to be understood that within the scope of the appended claims, the present disclosure may be practiced otherwise than as specifically described herein.

What is claimed as new and desired to be secured by Letters Patent of the United States is:

1. An image forming apparatus comprising:

an image carrier configured to carry a toner image;

a transfer unit configured to transfer the toner image on the image carrier onto a recording sheet;

a fixing unit configured to fix the toner image transferred at the transfer unit onto the recording sheet;

a conveyance path through which the recording sheet is conveyed from the transfer unit to the fixing unit;

a conveyance guide member disposed in the conveyance path on an image formation surface side of the recording sheet; and a fan configured to send air from the transfer unit to the conveyance path toward a gap defined between the conveyance guide member and the transfer unit so as to form a flow of air in the conveyance path from an upstream side to a downstream side in a conveyance direction of the recording sheet.

2. The image forming apparatus according to claim 1, wherein the transfer unit comprises a transfer belt configured to receive the toner image from the image carrier, carry the toner image, and transfer the toner image onto the recording sheet, wherein the conveyance guide member comprises a sheet guide portion configured to move the recording sheet along the conveyance path, and wherein the conveyance guide member comprises a distal end portion on the upstream side in the sheet conveyance direction, the distal end portion being positioned apart from the transfer belt so as to define the gap.

3. The image forming apparatus according to claim 2, wherein the conveyance guide member comprises an air guide portion extending from the distal end portion of the conveyance guide member toward the fan, and wherein an opening area is defined between the air guide portion and the transfer belt, and the air sent from the fan is guided to the opening area.

4. The image forming apparatus according to claim 3, wherein a first height is defined between the transfer belt and a distal end of the air guide portion on a side of the fan, and a second height is defined between the transfer belt and a lower end of the fan, and wherein the first height is greater than the second height.

5. The image forming apparatus according to claim 2, further comprising an air hole formed through the sheet guide portion, wherein the air sent from the fan flows into the conveyance path through the air hole.

6. The image forming apparatus according to claim 2, wherein the fan comprises an air sending surface inclined toward the gap.

7. The image forming apparatus according to claim 3, further comprising an air hole formed through the sheet guide portion, wherein the air sent from the fan flows into the conveyance path through the air hole.

8. The image forming apparatus according to claim 3, wherein the fan comprises an air sending surface inclined toward the gap.

9. The image forming apparatus according to claim 4, wherein the fan comprises an air sending surface inclined toward the gap.

10. The image forming apparatus according to claim 5, wherein the fan comprises an air sending surface inclined toward the gap.

11. The image forming apparatus according to claim 7, wherein the fan comprises an air sending surface inclined toward the gap.

* * * * *